US009325069B2

(12) United States Patent
Yussof et al.

(10) Patent No.: US 9,325,069 B2
(45) Date of Patent: Apr. 26, 2016

(54) TUNABLE COIL ANTENNA

(71) Applicant: Telecom Malaysia Berhad, Kuala Lumpur (MY)

(72) Inventors: Zulkalnain Mohd Yussof, Puchong (MY); Syahrizal Salleh, Rawang (MY)

(73) Assignee: TELEKOM MALAYSIA BERHAD, Kuala Lumpur (MY)

( * ) Notice: Subject to any disclaimer, the term of this patent is extended or adjusted under 35 U.S.C. 154(b) by 365 days.

(21) Appl. No.: 13/872,341

(22) Filed: Apr. 29, 2013

(65) Prior Publication Data

US 2013/0285783 A1 Oct. 31, 2013

(30) Foreign Application Priority Data

Apr. 30, 2012 (MY) ..... PI 2012700243

(51) Int. Cl.

| | |
|---|---|
| ***H01Q 7/00*** | (2006.01) |
| ***H01Q 1/22*** | (2006.01) |
| ***H01F 5/00*** | (2006.01) |
| ***H01F 41/04*** | (2006.01) |

(52) U.S. Cl.

CPC ..... *H01Q 7/005* (2013.01); *H01F 5/003* (2013.01); *H01F 41/045* (2013.01); *H01Q 1/2208* (2013.01)

(58) Field of Classification Search

CPC ..... H01Q 3/247; H01Q 7/00; H01Q 7/005
USPC ..... 343/868, 867, 870
See application file for complete search history.

(56) References Cited

U.S. PATENT DOCUMENTS

2013/0271343 A1* 10/2013 Thomas ..... G06K 19/07766 343/867

FOREIGN PATENT DOCUMENTS

WO WO2011157941 A1 * 12/2011

* cited by examiner

*Primary Examiner* — Robert Karacsony
(74) *Attorney, Agent, or Firm* — Jacobson Holman, PLLC

(57) ABSTRACT

A tunable coil antenna (2) is disclosed, in which the tunable coil antenna (2) comprises a first antenna terminal (12), and a series of two or more incomplete turns (4), each incomplete turn (4) comprising a first end (8) and a second end (10), the first end (8*a*) of the first incomplete turn (4*a*) being electrically connected to the first antenna terminal (12), the first end (8) of each subsequent incomplete turn (4) arranged to be electrically connected to the second end (10) of a preceding incomplete turn (4) in the series, the second end (10) of each incomplete turn (4) arranged to either be electrically connected to the first end (8) of a subsequent incomplete turn (4) in the series or to provide a second antenna terminal.

4 Claims, 7 Drawing Sheets

18a
22a
22b
24
20a
20b
18b

TUNABLE COIL ANTENNA

FIELD OF THE INVENTION

The present invention is generally related to a coil antenna and particularly, although not exclusively, related to a coil antenna arranged to receive an electromagnetic field.

BACKGROUND TO THE INVENTION

It is possible to transmit energy wirelessly between a pair of coil antennas (sometimes known as loop antennas). Typically, a power source is connected to a first antenna (or transmitting antenna) in which current flow induces an electromagnetic field around that antenna. A second antenna (or receiving antenna) in suitable proximity to the first antenna and electromagnetic field may have a current and voltage induced in and across its coils. The second antenna may then be used as a power source for example to charge a battery or to power an electronic device or passive RFID tag. The receiving antenna may be connected to a power converter to output power at a desired rating.

In some applications it may be desirable to maximise the voltage generated across the receiving antenna and it may be possible to do so by matching the positive reactance of the receiving coil with the negative reactance of the power converter, load, or any other associated components. Tuning the reactance or impedance of the receiving coil for a specific application may require manufacture of multiple antennas which can be expensive and time consuming.

It is an object of the present invention to provide an improved coil antenna, or at least to provide the public with a useful choice.

SUMMARY OF THE INVENTION

In a first aspect the invention broadly comprises a tunable coil antenna comprising:

a first antenna terminal; and a series of two or more incomplete turns, each incomplete turn comprising a first end and a second end, the first end of the first incomplete turn being electrically connected to the first antenna terminal, the first end of each subsequent incomplete turn arranged to be electrically connected to the second end of a preceding incomplete turn in the series, the second end of each incomplete turn arranged to either be electrically connected to the first end of a subsequent incomplete turn in the series or to provide a second antenna terminal.

Preferably, the first antenna terminal comprises a pad, and the tunable antenna comprises a first pad arranged to be electrically connected to the second antenna terminal.

Preferably, the tunable coil antenna comprises a bridging conductor electrically connected between the second antenna terminal and the second pad.

Preferably, the incomplete turns are arranged in the same plane.

Preferably, the bridging conductor forms an electrical connection between the second pad and a second end of an incomplete turn outside of the plane of the incomplete turns.

Preferably, the first end of each incomplete turn is arranged to be connected to the second end of a preceding incomplete turn through one or more electrically conductive jumpers such that a desired number of incomplete turns can be connected in series between the first antenna terminal and the second antenna terminal.

Preferably, the incomplete turns are provided on or within a single-layer or multi-layer printed circuit board.

Preferably, the second end of each incomplete turn is provided with an associated via extending through at least one layer of the printed circuit board.

Preferably, each incomplete turn is substantially square-shaped or rectangular-shaped.

Preferably, each incomplete turn substantially surrounds and envelopes any subsequent incomplete turns such that each incomplete turn envelopes a smaller area than its preceding incomplete turn.

In a second aspect the invention broadly comprises a method of tuning a coil antenna comprising connecting in series a first antenna terminal and one or more incomplete turns such that a desired number of incomplete turns are connected into the antenna.

Preferably, the method of tuning a coil antenna comprises the step of closing the antenna by connecting a bridging conductor between a second end of an incomplete turn and a second antenna terminal.

Preferably, one or more incomplete turns are removed from or added in series between the first antenna terminal and second antenna terminal to tune the antenna.

Preferably, the antenna inductance, reactance, or impedance is measured after each change to the number of incomplete turns until a desired inductance, reactance, or impedance is measured.

Preferably, one or more electrically conductive jumpers are used to make one or more connections between a first end of an incomplete turn and a second end of a preceding incomplete turn.

Preferably, one or more electrically conductive jumpers are used to make a connection between a second end of an incomplete turn and the second antenna terminal.

In a third aspect the invention broadly comprises a kit of parts comprising:

a tunable coil antenna comprising:

a first antenna terminal; and a series of two or more incomplete turns, each incomplete turn comprising a first end and a second end, the first end of the first incomplete turn being electrically connected to the first antenna terminal, the first end of each subsequent incomplete turn arranged to be electrically connected to the second end of a preceding incomplete turn in the series, the second end of each incomplete turn arranged to either be electrically connected to the first end of a subsequent incomplete turn in the series or to provide a second antenna terminal; and one or more electrically conductive bridging conductors arranged to electrically connect with the first end or second end of any incomplete turn or the second antenna terminal.

Preferably, one or more bridging conductors are jumpers.

BRIEF DESCRIPTION OF THE DRAWINGS

Preferred embodiments of the invention will be described by way of example only and with reference to the drawings, in which.

DETAILED DESCRIPTION OF EMBODIMENTS OF THE INVENTION

The invention is generally related to a coil antenna and a method of tuning a coil antenna. Generally an incomplete antenna comprising a series of incomplete turns is provided. The antenna may be completed or built by sequentially connecting a number of incomplete turns in series with a terminal or two terminals through, for example, electrically conductive jumpers until a desired antenna reactance or impedance is reached to thereby tune the antenna.

Figure 1A:
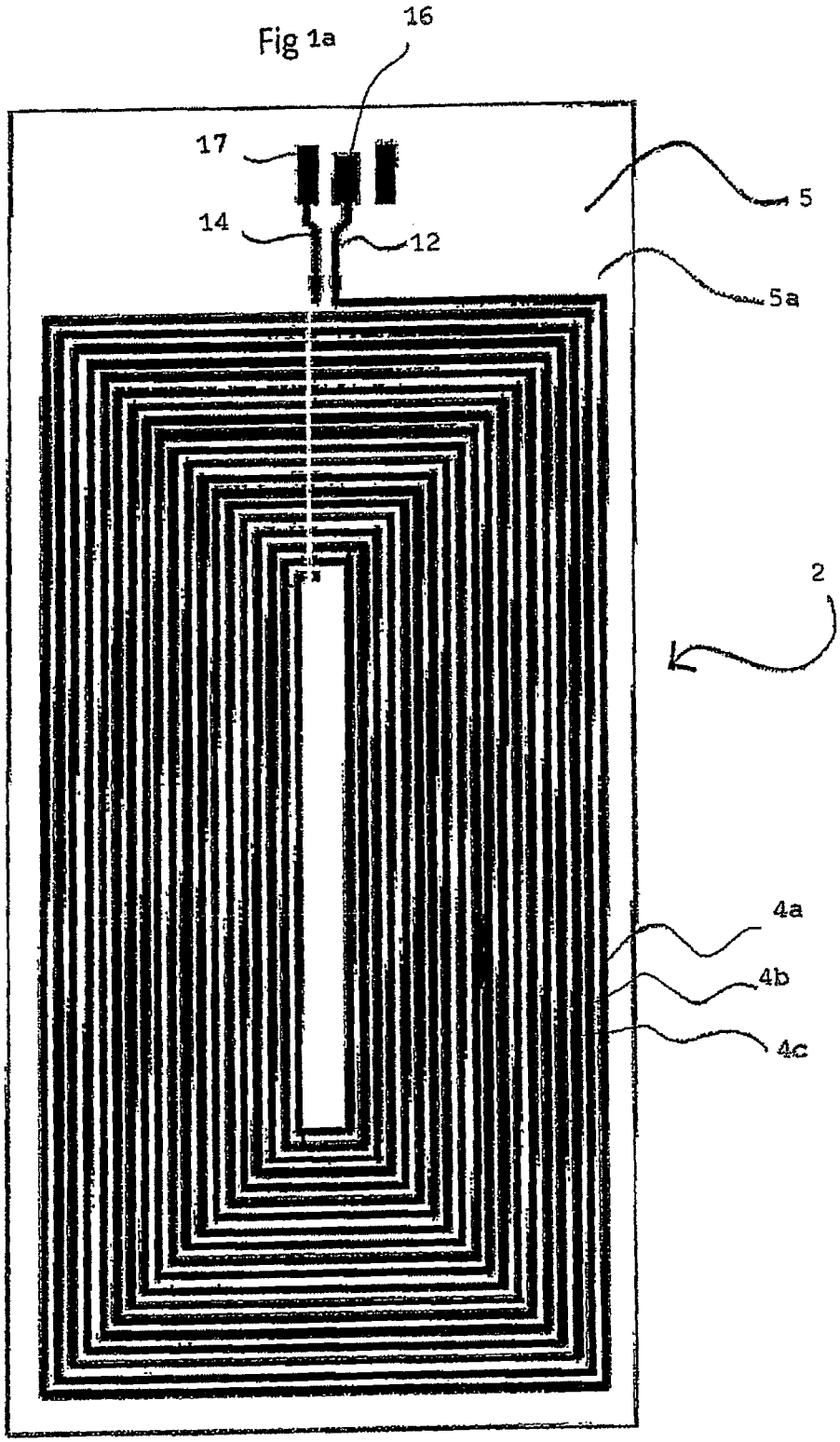
FIG. 1*a* is a top-side PCB schematic of a tunable coil antenna according to an embodiment of the invention.
Figure 1B:
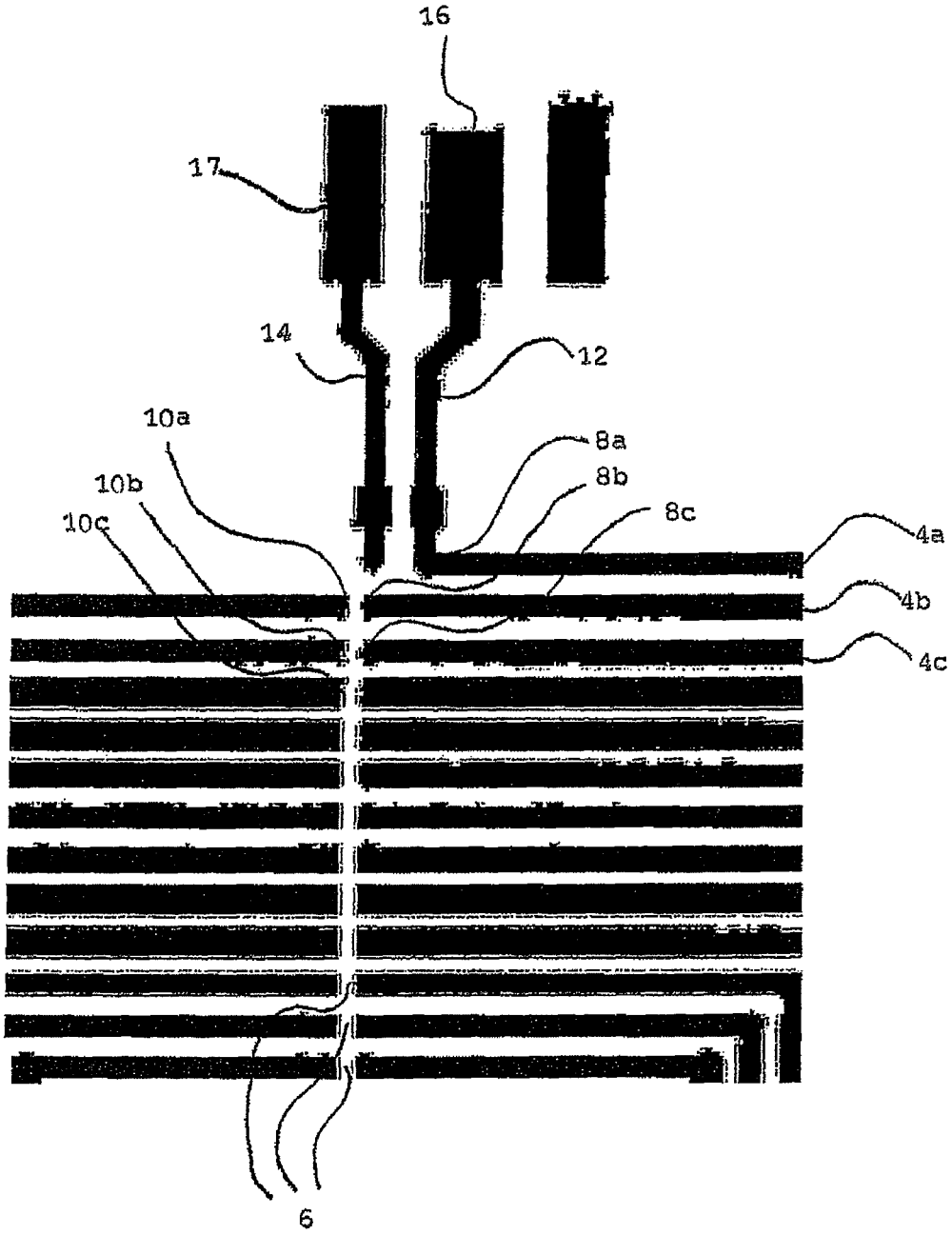
FIG. 1*b* is a close-up view of a portion of the schematic of FIG. 1*a;*
Figure 2:
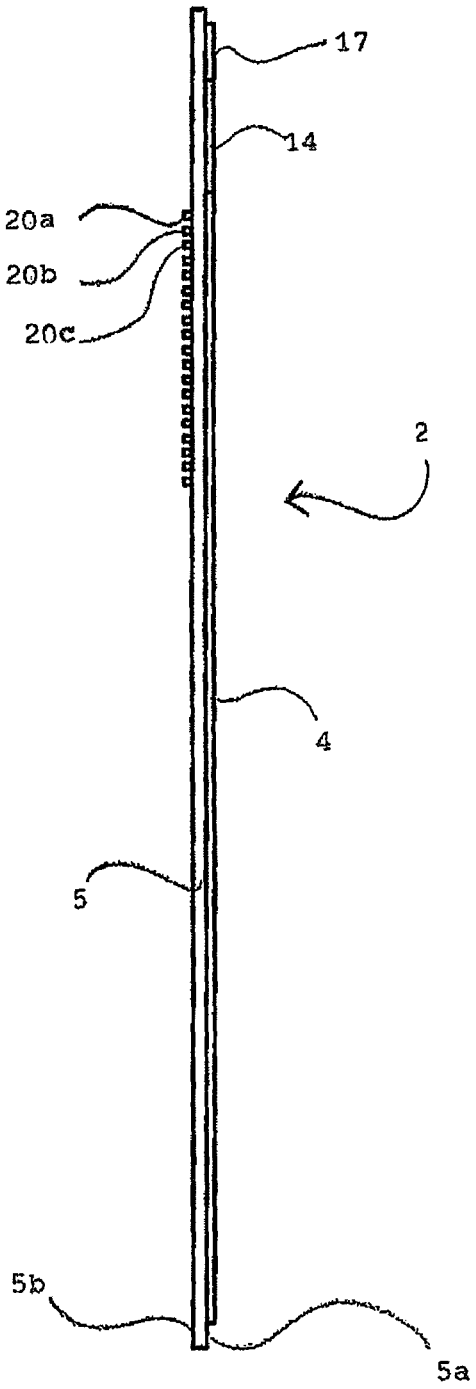
FIG. 2 is a side view of the PCB schematic of FIG. 1 showing traces with exaggerated height.

Referring to FIGS. 1*a*, 1*b* and 2 a tunable coil antenna 2 comprises a series of two or more incomplete turns 4 which are made from an electrically conductive material such as copper. The incomplete turns 4 may be provided on or within a single-layer or multi-layer printed circuit board (PCB) 5. The incomplete turns 4 may be copper traces on the PCB 5. The PCB generally has a top-side 5*a* and a bottom-side 5*b*. Referring to FIG. 1*b*, each incomplete turn 4 comprises a non-conductive gap 6 which defines a first end 8 and a second end 10 of each incomplete loop. For example, a first incomplete turn 4*a* has a gap 6 between a first end 8*a* a second end 10*a*. Further, a second incomplete turn 4*b* has a gap 6 between a first end 8*b* a second end 10*b*, and so on. The ends 8,10 are arranged to be connected to a connector (not shown in FIG. 1*b*) such that the gaps 6 may be electrically bridged in particular configurations. The ends 8,10 may be suitably connected to one another or to some other external circuitry.

Referring to FIGS. 1*a*, 1*b* and 2, the tunable coil antenna 2 comprises a first terminal 12, however the first terminal 12 may simply be the first end 8*a* of the first incomplete turn 4*a* or any other suitable point of the tunable coil antenna 2. The first terminal 12 is preferably hard-wired to the first end 8*a* of the first incomplete turn 4*a* in embodiments where the first terminal 12 is a distinct component. Similarly, the tunable coil antenna 2 comprises a second terminal 14, however the second terminal 14 may simply be a second end 10 of a suitable incomplete turn 4 or any other suitable point of the tunable coil antenna 2. The second terminal 14 is generally not hard-wired to a second end 10 of an incomplete turn 4 in embodiments where the second terminal 14 is a distinct component. The first terminal 12 may be connected to a first pad 16 and second terminal 14 may be connected to a second pad 17, the pads 16,17 being arranged to connect the tunable coil antenna 2 to a power source or some other external circuitry. FIG. 1*b* also shows a series of contact pads 20 (discussed further below).

Figure 3:
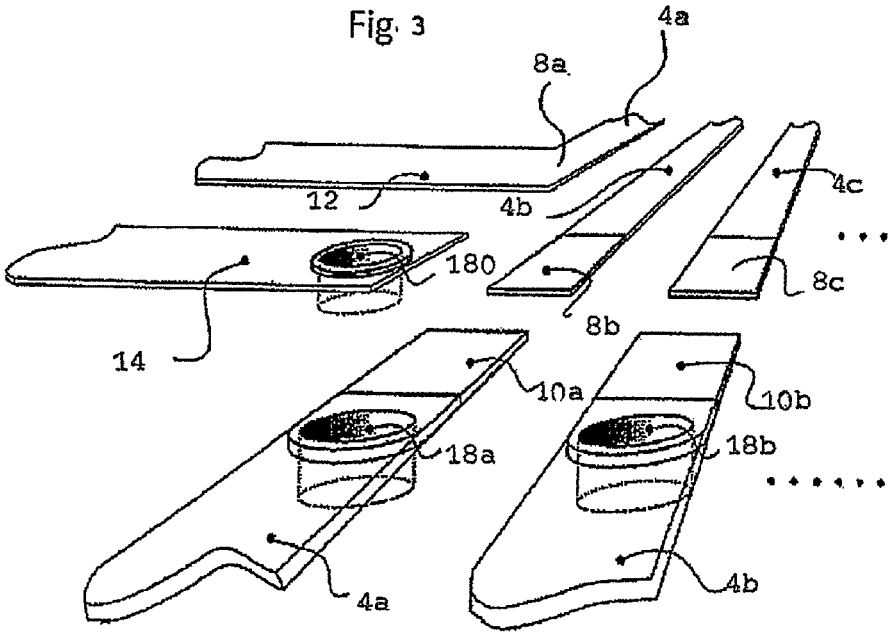
FIG. 3 is a partial cutaway perspective view showing traces and vias on the top-side of a PCB (not shown) of a portion of the tunable coil antenna of FIG. 1.

Referring to FIGS. 1*a*, 1*b* and 3, the first terminal 12 (if provided as a distinct component from the incomplete turns 4) may be hard-wired to the first end 8*a* of the first incomplete turn 4*a*. In some embodiments the first incomplete turn 4*a* circumnavigates a substantial proportion of the PCB 5 and may be provided close to three or more periphery edges of the PCB. In such embodiments the first incomplete turn 4*a* may substantially surround and envelope the second incomplete turn 4*b* and any subsequent incomplete turns 4. Generally each incomplete turn 4 envelopes a smaller area than its preceding incomplete turn 4. The incomplete turns 4 may be substantially rectangular or square or any other suitable shape such as circular or elliptical. The two or more incomplete turns 4 are preferably provided in the same plane, such as on the same side of a PCB.

Referring to FIG. 3 (in which solid lines represent incomplete turns 4 provided on the top-side of the PCB), the first end 8*a* of the first incomplete loop 4*a* may be electrically connected to the first terminal 12. In other embodiments the first end 8*a* itself may be the first terminal 12. The first incomplete turn 4*a* circumnavigates the PCB (as shown in FIG. 1) and terminates at the second end 10*a* of the first incomplete turn 4*a*. The first end 8*b* of the second incomplete turn 4*b* is provided in proximity to, but not electrically connected to, the second end 10*a* of the first incomplete turn 4*a* such that the two ends 10*a*,8*b* may be connected by a connector. Similarly, the second incomplete turn 4*b* circumnavigates the PCB (as shown in FIG. 1) and terminates at the second end 10*b* of the second incomplete turn 4*b*. The first end 8*c* of the third incomplete turn 4*c* is provided in proximity to, but not electrically connected to, the second end 10*b* of the second incomplete turn 4*b* such that the two ends 10*b*,8*c* may be connected by a connector. This pattern may repeat with a desired number of incomplete turns 4 such that the first end 8 of each subsequent incomplete turn 4 may be electrically connected to the second end 10 of preceding incomplete turns 4. The second end 10 of each incomplete turn 4 is arranged to be connected either to the first end of subsequent incomplete turns 4 or externally to another circuit to close the antenna.

The ends 8,10 may comprise or be formed from contact pads, terminals, vias, conductive apertures arranged to receive jumpers or any other suitable structure such that they may be connected to one another, the terminals 12,14, or an external circuit (for example, a power source, power converter or load).

The second end 10 of each incomplete turn 4 may be connectable to the second terminal 14 or externally through a via 18 provided in close proximity. A via 180 may be provided electrically connected to the second terminal 14 if provided.

Figure 4:
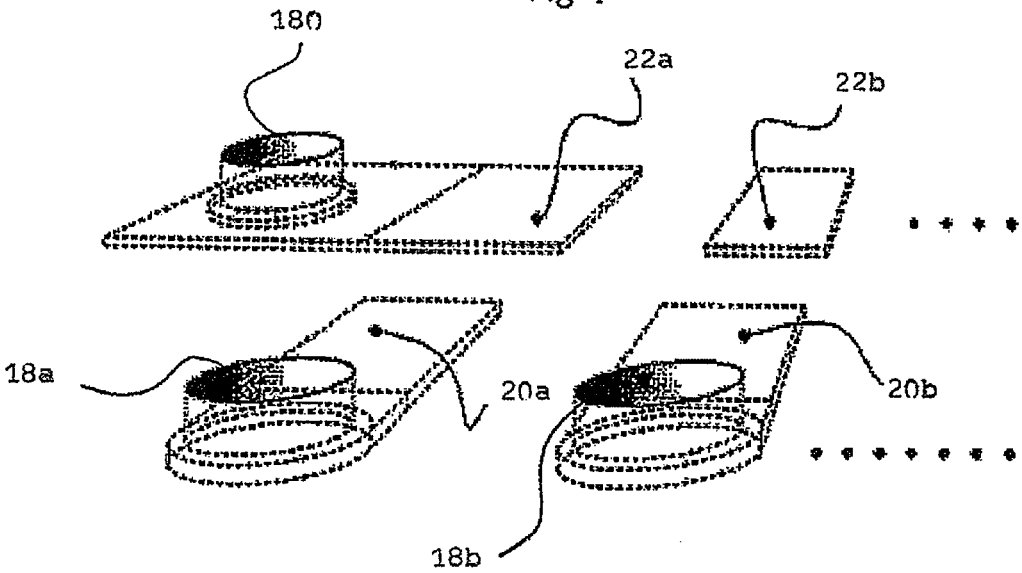
FIG. 4 is the same view as FIG. 3 showing traces on the bottom-side of the PCB (not shown) and the vias of FIG. 3.
Figure 5:
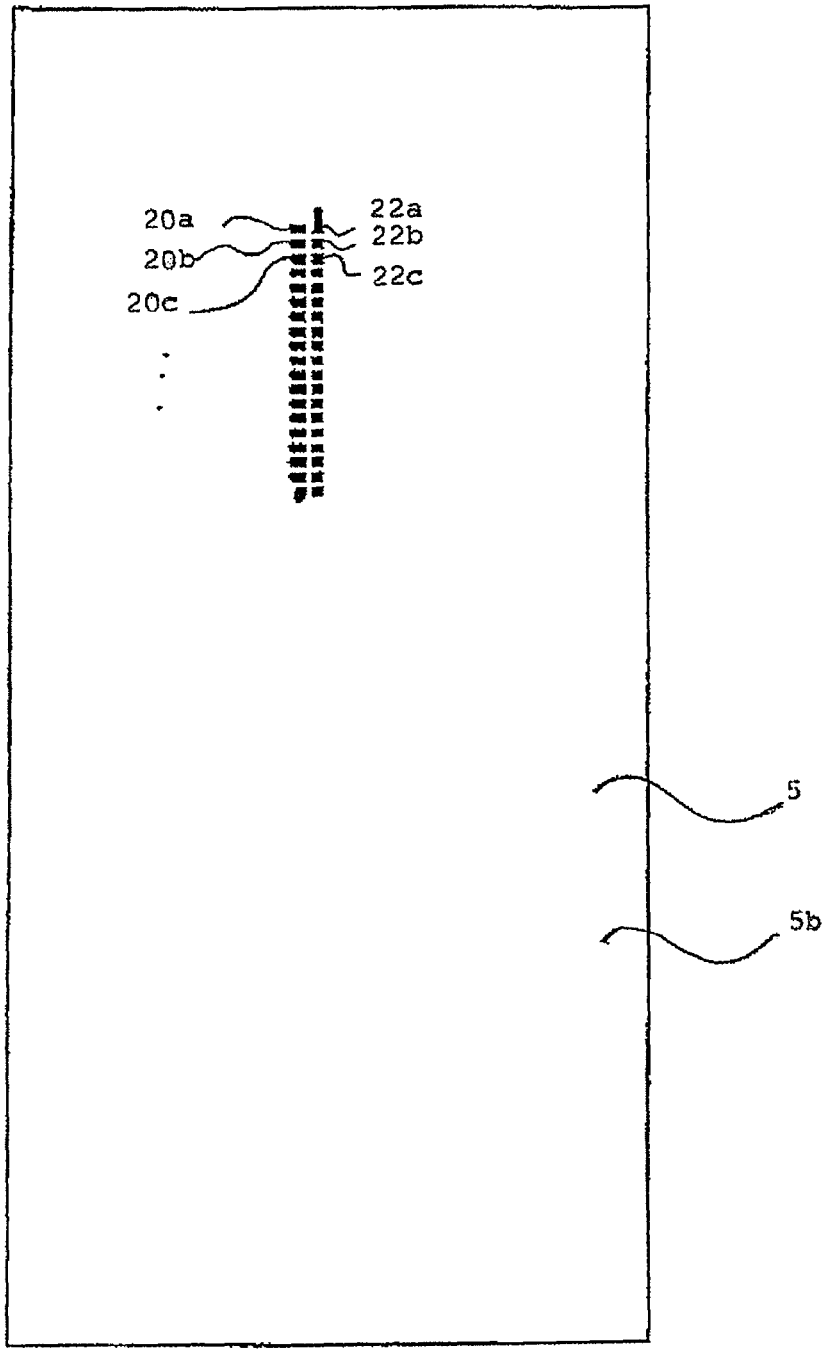
FIG. 5 is the bottom-side PCB schematic of FIG. 1 showing two series of contact pads.

Referring to FIGS. 4 (in which dotted lines represent contact pads or PCB traces provided on the bottom-side of the PCB) and 5, in a preferred embodiment of the invention a first series of bottom-side contact pads 20 are electrically connected to a corresponding via 18 (which is connected to the second end 10 of an incomplete turn 4). In this embodiment, each of the first series of bottom-side contact pads 20 has a corresponding partner in a second series of bottom-side contact pads 22 that is in close proximity. The contact pads 20,22 may alternatively be terminals, vias, conductive apertures arranged to receive jumpers or any other suitable structure such that each of the bottom-side contact pads of the first series 20 are electrically connectable with their corresponding partner in the second series of bottom-side contact pads 22.

Figure 6:
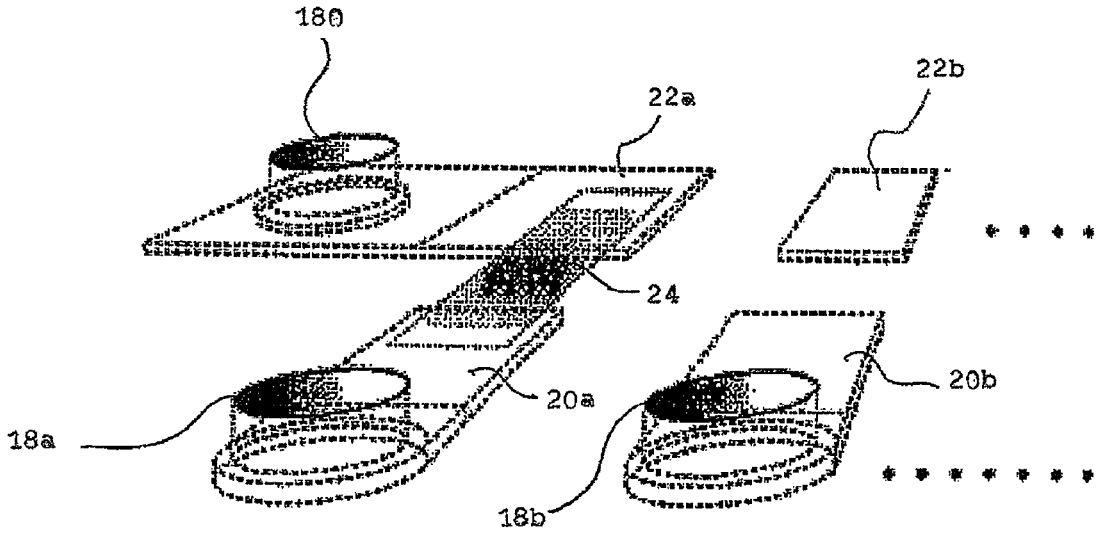
FIG. 6 is the same view as FIG. 4 showing the antenna configured with one turn.

Referring to FIG. 6, a bridging conductor configuration to connect one turn into the tunable coil antenna is shown. In this configuration, a connector 24 is connected between bottom-side pad 20*a* and corresponding bottom-side pad 22*a*. The connector 24 could be any suitable electrical connection such as an electrical jumper, solder, an insulated or non-insulated piece of wire or a metal plate. With reference now to FIGS. 3 and 6, the completed or closed antenna circuit begins at the first terminal 12, passes through the first end 8*a* of the first incomplete turn 4*a*, continues around the first incomplete turn 4*a*, down through the PCB through via 18*a*, through contact pad 20*a*, across connector 24, through contact pad 22*a*, up through the PCB through via 180, and finally into the second terminal 14. This particular example illustrates one turn connected into the antenna, and as such no connectors are required on the top-side of the PCB.

In this specification, a bridging conductor is considered any combination of connectors 24, vias, contact pads and other suitable components that close or bridge the tunable coil antenna circuit outside of the plane of the incomplete turns. In the example of FIGS. 3 and 6 above, the bridging conductor may be considered the connector 24 alone, or the connector 24 in combination with one or both vias 18*a*,180. In another embodiment of the invention, the antenna circuit may be closed or bridged by for example a piece of insulated wire connected between the second end 10*a* and the second terminal 14, in which case the insulated wire is considered the bridging conductor. In other embodiments, the bridging conductor may comprise any number and combination of connectors, vias, contact pads and other suitable components. Other configurations which do not depart from the spirit or scope of the invention may be possible.

Figure 7:
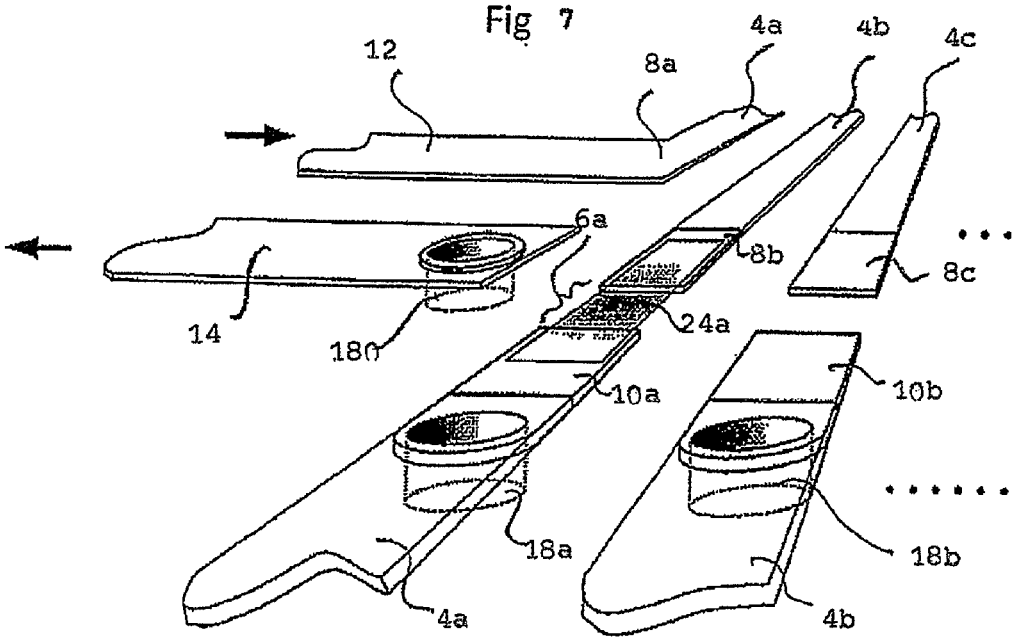
FIG. 7 is the same view as FIG. 3 showing the antenna configured with two turns.
Figure 8:
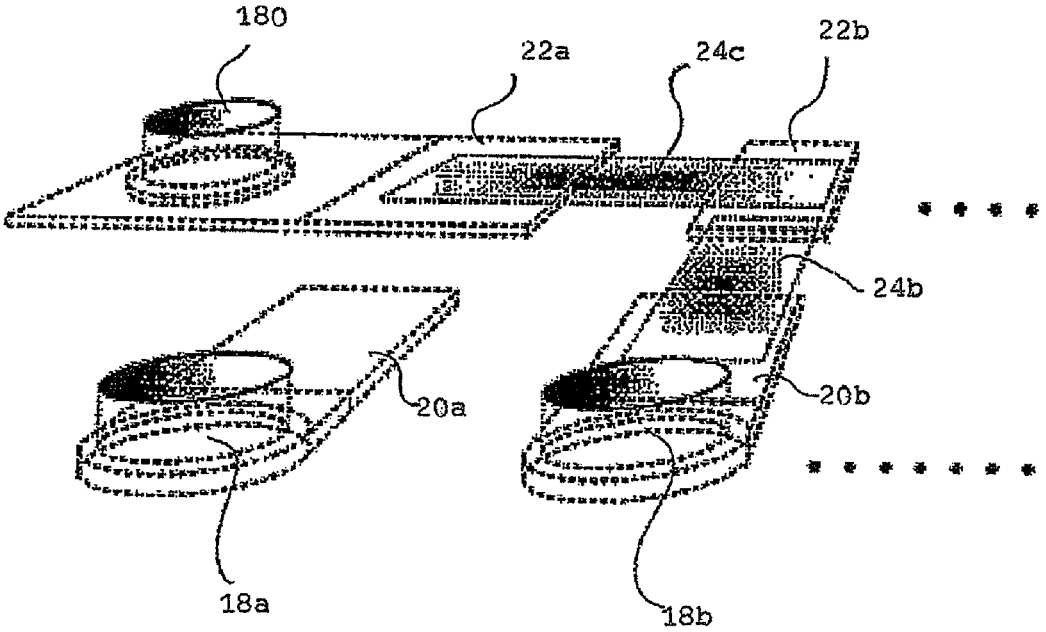
FIG. 8 is the same view as FIGS. 4 and 6 showing the antenna configured with two turns.

Referring to FIGS. 7 and 8, a jumper configuration to connect two turns into the tunable coil antenna is shown. In this configuration, three connectors 24 are connected over various parts of the tunable coil antenna circuit as required. The completed or closed antenna circuit begins at the first terminal 12, passes through the first end 8*a* of the first incomplete turn 4*a*, continues around the first incomplete turn 4*a*, around via 18*a* (which stays unconnected in this configuration), into the second end 10*a* of the first incomplete turn 4*a*, bridges the gap 6*a* through connector 24*a*, into the first end 8*b* of the second incomplete turn 4*b*, continues around the second incomplete turn 4*b*, down through the PCB through via 18*b*, through contact pad 20*b*, across connector 24*b*, through contact pad 22*b*, across connector 24*c*, through contact pad 22*a*, up through the PCB through via 180, and finally into the second terminal 14. This particular example illustrates two turns connected into the antenna.

A desired number of turns can be connected into the antenna by connecting or bridging appropriate first ends 8 with their corresponding second ends 10 on the top-side of the PCB and connecting or bridging an appropriate contact pad 20 with its corresponding contact pad 22, and then connecting or bridging from that contact pad 22 to via 180. For example, if four antenna turns are desired, the first four first ends 8 are connected with their corresponding second ends 10, the fourth contact pad 20 is connected with the corresponding fourth contact pad 22, and the fourth contact pad 22 is connected to via 180 through three connectors 24. This configuration of connections brings the antenna circuit out of the plane of the incomplete turns 4 to make the bridging connection on the bottom-side of the PCB. It may be possible to make the bridging connection in other ways for example such as connecting the final second end 10 to the second terminal 14 or some other external circuitry directly with a wire (which will be out of the plane of the incomplete turns 4), in which the final second end 10 provides the second terminal.

A complete antenna with one turn may be connected using, for example, a bridging conductor comprising jumpers. The inductance, reactance or impedance may be then measured and more turns may be connected until the inductance, reactance or impedance is equal to or close to a desired inductance, reactance or impedance. Turns may be removed in a similar fashion in case of an overshoot. In some applications, such as when the antenna is used as a receiving coil in energy transfer, it may be desirable to match the antenna impedance at resonance with the impedance of some external circuitry to maximise the open circuit voltage across the antenna and therefore maximise energy transfer.

The foregoing description of the invention includes preferred forms thereof. Modifications may be made thereto without departing from the scope of the invention as defined in the accompanying claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The term "coil antenna" as used in this specification and claims is analogous to and interchangeable with the term "loop antenna". The term "coil antenna" is to be interpreted as having the same definition as the term "loop antenna". Related terms are to be interpreted in the same manner.

The invention claimed is:

1. A tunable coil antenna consisting of:

a first antenna terminal; and a series of two or more incomplete turns, each incomplete turn consisting of a first end and a second end, the first end of the first incomplete turn being electrically connected to the first antenna terminal, the first end of each subsequent incomplete turn arranged to be electrically connected to the second end of a preceding incomplete turn in the series, the second end of each incomplete turn arranged to either be electrically connected to the first end of a subsequent incomplete turn in the series or to provide a second antenna terminal;

wherein the first antenna terminal comprises a first pad, and the second antenna terminal comprises a second pad arranged to be electronically connected to the second antenna terminal;

wherein bridging conductor electrically connected between the second antenna terminal and the second pad;

wherein the incomplete turns are arranged in the same plane on or within a single-layer printed circuit board or a multi-laver printed circuit board;

where the bridging conductor forms an electrical connection between the second pad and a second end of an incomplete turn outside of the plane of the incomplete turns; and where the first end of each incomplete turn is arranged to be connected to the second end of a preceding incomplete turn though one or more electrically conductive jumpers such that a desired number of incomplete turns can be connected in series between the first antenna terminal and the second antenna terminal;

wherein the second end of each incomplete turn is provided with an associated via extending through at least one layer of the printed circuit board;

wherein each incomplete turn is substantially square-shaped or rectangular-shaped; and wherein each incomplete turn substantially surrounds and envelopes any subsequent incomplete turns such that each incomplete turn envelopes a smaller area than its preceding incomplete turn.

2. The tunable coil antenna according to claim 1, wherein the incomplete turns are arranged in the same plane on or within a single-layer printed circuit board.

3. A kit of parts consisting of:

a tunable coil antenna comprising:

a first antenna terminal; and a series of two or more incomplete turns, each incomplete turn consisting of a first end and a second end, the first end of the first incomplete turn being electrically connected to the first antenna terminal, the first end of each subsequent incomplete turn arranged to be electrically connected to the second end of a preceding incomplete turn in the series, the second end of each incomplete turn arranged to either be electrically connected to the first end of a subsequent incomplete turn in the series or to provide a second antenna terminal; and one or more electrically conductive bridging conductors arranged to electrically connect with the first end or second end of any incomplete turn or the second antenna terminal;

wherein the first antenna terminal comprises a first pad, and the second antenna terminal comprises a second pad arranged to be electrically connected to the second antenna terminal;

wherein a bridging conductor electrically connected between the second antenna terminal and the second pad;

wherein the incomplete turns are arranged in the same plane on or within a single-laver printed circuit board or a multi-layer printed circuit board;

where the bridging conductor forms an electrical connection between the second pad and a second end of an incomplete turn outside of the plane of the incomplete turns; and where the first end of each incomplete turn is arranged to be connected to the second end of a preceding incomplete turn through one or more electrically conductive jumpers such that a desired number of incomplete turns can be connected in series between the first antenna terminal and the second antenna terminal;

wherein the second end of each incomplete turn is provided with an associated via extending through at least one layer of the printed circuit board;

wherein each incomplete turn is substantially square-shaped or rectangular shaped; and wherein each incomplete turn substantially surrounds and envelopes any subsequent incomplete turns such that each incomplete turn envelopes a smaller area than its preceding incomplete turn.

4. The kit of parts according to claim 3 where one or more bridging conductors are jumpers.

* * * * *